United States Patent [19]

Elsässer

[11] 4,282,724

[45] Aug. 11, 1981

[54] CONTROL MAGNET SYSTEM

[75] Inventor: Heinrich Elsässer, Stuttgart, Fed. Rep. of Germany

[73] Assignee: Sulzer Morat GmbH, Fed. Rep. of Germany

[21] Appl. No.: 122,866

[22] Filed: Feb. 20, 1980

[30] Foreign Application Priority Data

Feb. 23, 1979 [DE] Fed. Rep. of Germany ..... 2907008

[51] Int. Cl.[3] ..... D04B 7/00; D04B 15/66

[52] U.S. Cl. ..... 66/75.2; 66/219

[58] Field of Search ..... 66/75.2, 219, 220, 231, 66/232

[56] References Cited

U.S. PATENT DOCUMENTS

| | | | |
|---|---|---|---|
| 3,262,285 | 7/1966 | Beguin et al. | 66/220 |
| 3,365,916 | 1/1968 | Ribler et al. | 66/219 |
| 3,667,254 | 6/1972 | Paepke | 66/219 |
| 3,812,691 | 5/1974 | Engelfried | 66/219 |
| 3,974,664 | 8/1976 | Erb | 66/75.2 |
| 4,127,012 | 11/1978 | Schmid et al. | 66/75.2 |
| 4,196,599 | 4/1980 | Guell | 66/220 |

FOREIGN PATENT DOCUMENTS

| | | | |
|---|---|---|---|
| 1500569 | 11/1965 | France | 66/75.2 |

*Primary Examiner*—Ronald Feldbaum

[57] ABSTRACT

A control magnet system for a pattern apparatus on a textile machine, in particular a knitting machine, comprises a permanent magnet which includes a control pole having a pole surface and controllable by means of a control coil and a co-operating pole having a pole surface, and comprises at least one armature which is movable relative to the two poles and which can be applied against the pole surface of the control pole against a spring force in such a manner that, when the control coil is not energized, the armature remains against the pole surface of the control pole by virtue of the magnetic force produced by the permanent magnet, whereas, when the control coil is energized the armature is released from the pole surface of the control pole by virtue of the spring force, wherein the pole surface of the control pole is perpendicular to the direction of release of the armature, and the pole surface of the co-operating pole is perpendicular to the pole surface of the control pole (FIG. 2).

7 Claims, 10 Drawing Figures

CONTROL MAGNET SYSTEM

Figure 1:
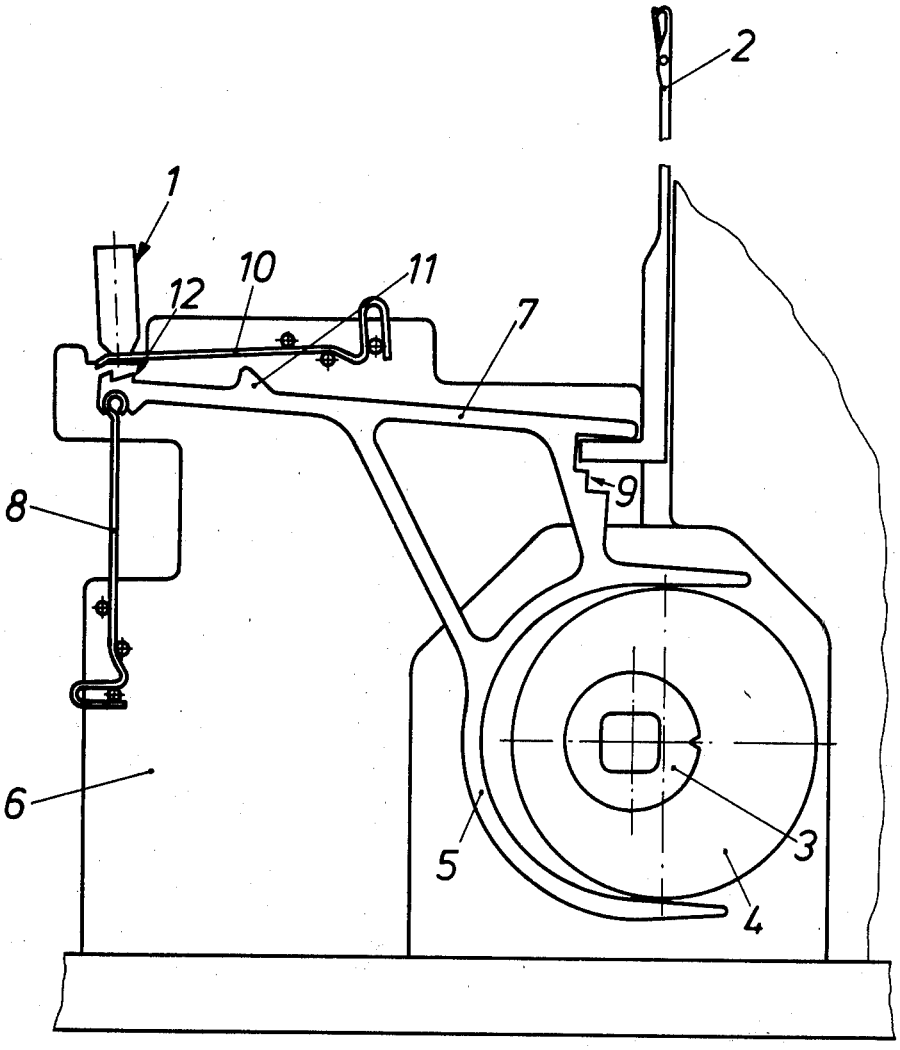

The invention relates to a control magnet system for a pattern apparatus on a textile machine, in particular a knitting machine, comprising at least one permanent magnet which includes at least one control pole having a pole surface and controllable by means of a control coil and at least one co-operating pole having a pole surface, and comprising at least one armature which is freely movable relative to the two poles and which can be applied against the pole surface of the control pole against a spring force in such a way that, when the control coil is not energised, the armature remains against the pole surface of the control pole by virtue of the magnetic force produced by the permanent magnet, whereas, when the control coil is energised, the armature is released from the pole surface of the control pole by virtue of the spring force, wherein the pole surface of the control pole is arranged substantially perpendicular to the direction of release of the armature.

In known control magnet systems of this kind (DAS No. 15 85 206), the armatures comprise spring bars which are fixedly gripped at their one end. The pole surfaces of the control pole and the co-operating pole, which surfaces co-operate with the free end of the armatures, are arranged in the same plane and, in the attracted condition, are bridged by the contact surface of the armature to be controlled, the contact surface also being disposed in that plane. This arrangement gives the advantage that only a small part of the armature has the magnetic flux passing therethrough, and therefore good magnetic characteristics can be achieved even when the material used for the spring bars has good spring qualities but is of low magnetic conductivity. It will be appreciated that, in the known control magnet system, the spring force is also arranged substantially perpendicular to the plane formed by the pole surfaces of the control pole and the co-operating pole. The result of this is that the armature is released only when on the one hand the magnetic field produced by the control pole in the attracted condition is reduced, compensated or sufficiently reversed in polarity, and when on the other hand the residual attraction force produced by the co-operating pole in the above-indicated operating condition is lower than the spring force. Therefore, because of the spring forces which are often very different when there is a very large number of armatures, for example a thousand armatures, the arrangement may suffer not only from armatures being released at different moments, but the apparatus may also suffer from totally defective control actions. Although such defects in control could be avoided by all the co-operating poles provided also being in the form of control poles, this is undesirable because there is not sufficient space for providing the control coils, particularly when the arrangement has a small pitch.

In order to avoid the above-indicated defective control actions and to simplify adjustment, it is also known for the control magnet systems or parts thereof to be made adjustable or displaceable (DAS No. 15 85 206). This arrangement however does not make it possible to eliminate every defective control action, as it is in particular impossible to compensate for different bending phenomena, which occur as a result of the manufacturing process or which arise during operation, in respect of the armatures which are generally in the form of spring bars, relative to the pole surfaces. Apart from this consideration, precisely adjusting every individual control magnet system would represent an unacceptable cost factor on a machine with a thousand control magnet systems and more. For this reason, control or pattern defects repeatedly occur in controlling textile machines, in particular knitting machines (see also DAS No. 15 85 211 or DOS No. 25 31 762).

A further reason for defective control operations to occur is the fact that, in the known control magnets, the contact surfaces of each armature must as far as possible lie in a parallel condition against the two pole surfaces of the control pole and the co-operating pole, when the armature is attracted. Slight deviations from a parallel condition as defined above result in substantial changes in the magnetic attraction forces, by virtue of the air gaps which then occur between the pole and the contact surfaces. Corresponding changes occur if a plurality of control and/or co-operating poles are provided for each permanent magnet, instead of only one control or co-operating pole, or if a small gap is intentionally maintained in the attracted condition between the pole surfaces and the contact surfaces of the armature, in order to avoid excessively rapid wear of the pole surfaces (see for example DAS No. 21 50 360). In fact, air gaps of this kind may be avoided by known control magnet systems with rounded control pole surfaces (German patent specification No. 15 35 270). It will be appreciated that these known control magnet systems differ from the control magnet systems of the general kind defined at the beginning of this specification, insofar as one end of the armature which is in the form of a spring bar is secured directly to the co-operating pole of the permanent magnet, so that such an arrangement enjoys either good magnetic but poor mechanical properties or, conversely, good mechanical but only poor magnetic properties.

The invention is based on the problem of designing the control magnet system of the kind indicated at the beginning of this specification, in such a way that it operates rapidly and reliably, while being substantially insensitive to armatures which are bent or not properly positioned, which requires the provision of only a single control pole but which nonetheless can enjoy good magnetic and good mechanical characteristics.

This problem is solved by the pole surface of the co-operating pole being arranged substantially perpendicular to the pole surface of the control pole.

This invention differs from the known control magnet systems of the general kind defined at the beginning of this specification, essentially by virtue of the configuration and the relative position of the pole surfaces of the control pole and the co-operating pole relative to each other. In the known control magnet systems, the two pole surfaces are disposed substantially in one plane, which results in the above-indicated difficulties. According to the invention, in contrast, the pole surfaces of the control pole and the co-operating pole are for example perpendicular to each other. Although this arrangement provides that the space between the control pole and the co-operating pole is also bridged essentially only by a small part of the armature, the lines of magnetic force between the armature and the co-operating pole form an angle to the lines of force between the armature and the control pole and thus also an angle to the direction in which the spring force acts when the armature is released. Therefore, the co-operating pole seeks to attract the armature in a direction perpendicular to the direction of movement thereof, that is to say, the co-operating pole contributes nothing or only a little to the attraction or holding force which is operative in the attracted condition. This in turn has the result that it is essentially only necessary to compensate for the attraction force of the control pole, if the armature is to be released. The attraction force which is exerted by the co-operating pole when the armature is released has been found by practical testing to be non-critical insofar as the frictional force which it produces is substantially less than the spring force which is usually applied to the armature, and does not substantially delay release of the armature. Up to at least 2000 armature releases per minute can be performed, without the release moments changing in a manner which is critical in relation to modern pattern apparatuses.

For the purposes of adaptation to different contact angles of the armature, the pole surface of the control pole advantageously has a rounded configuration with a large radius of curvature. By virtue of this arrangement, when the armature is for example in the form of a spring bar, it can lie against the pole surface of the control pole at angles of for example $-15°$ to $+15°$ without this resulting in the magnetic conditions which are important for the control action substantially changing and without it being necessary for the magnetic flux to pass virtually through the entire armature.

When the control magnet system according to the invention is used in a flat knitting machine, a multiplicity of control magnet systems, as set forth in claim 6 or claim 7, is advantageously combined to form a pack or unit. This arrangement advantageously provides a compact, space-saving arrangement and easy adjustment.

Further advantageous features of the invention are characterised in the other subsidiary claims.

The invention may be used with particular advantage in flat knitting machines wherein each knitting needle has associated therewith an eccentric which provides for pushing the needle forward and pulling it backwards, and a control magnet system for controlling the selective coupling of a needle to the eccentric (DOS No. 25 31 762).

Figure 2:
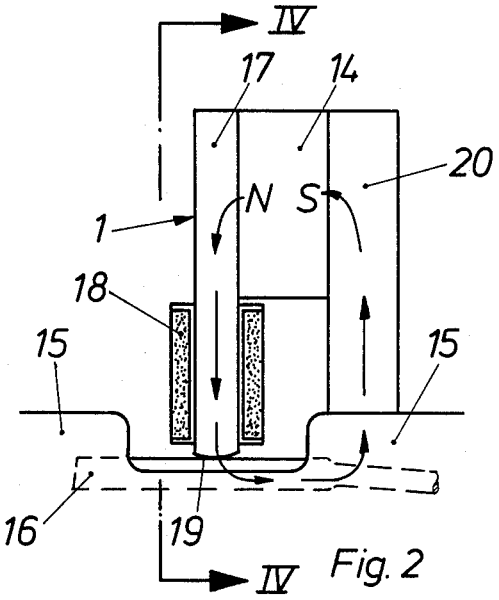
Figure 3:
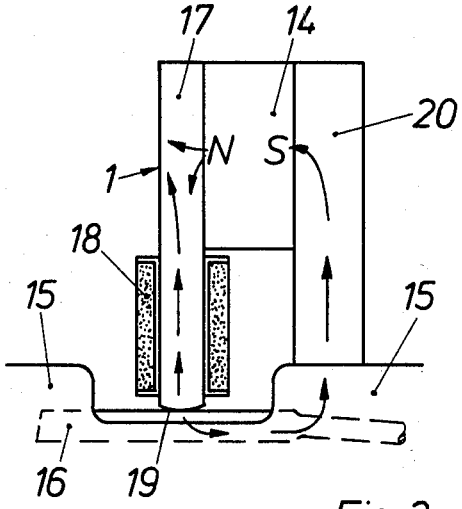
Figure 4:
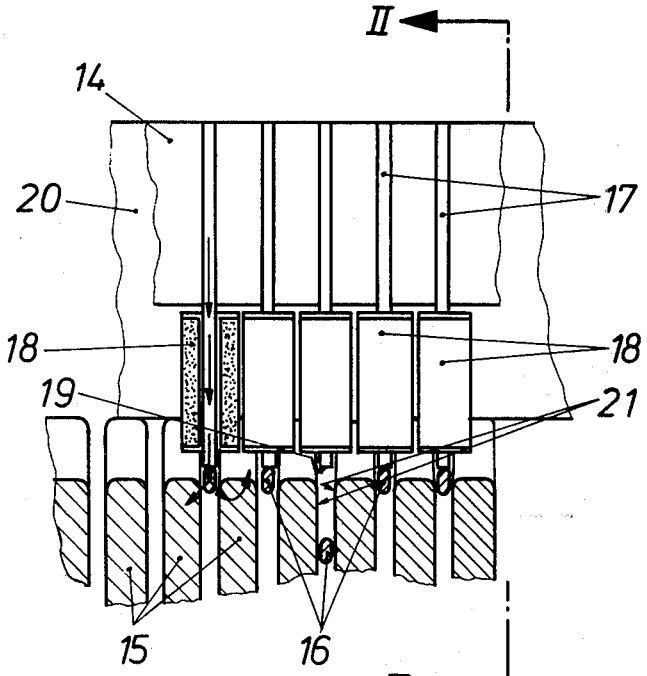
Figure 5:
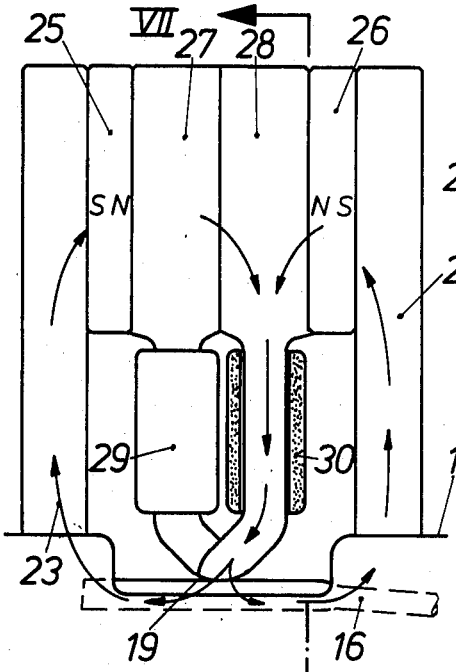
Figure 6:
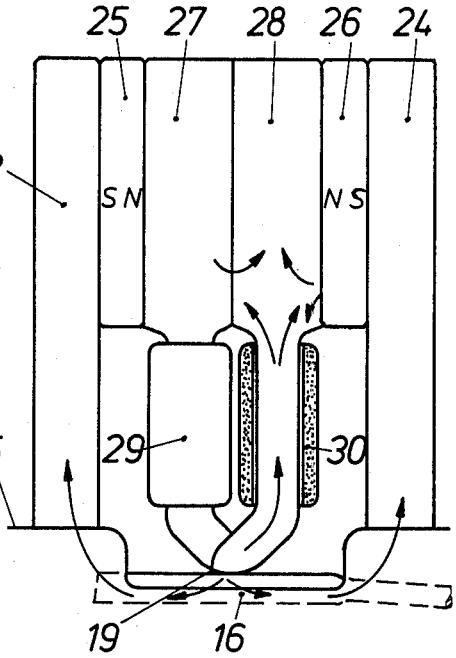
Figure 7:
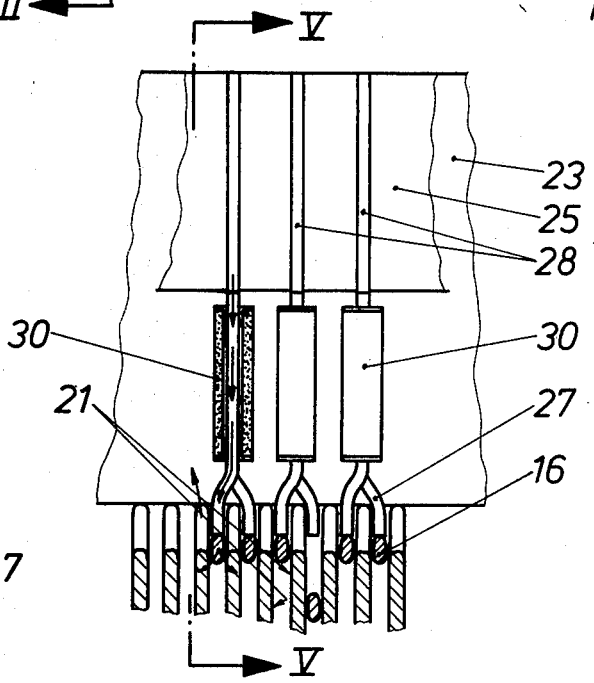

Embodiments of the invention are described in greater detail hereinafter with reference to the accompanying drawings in which:

FIG. 1 is a diagrammatic side view of one form of use of the control magnet system according to the invention, FIG. 2 shows a view of a control magnet system according to the invention, in section taken along line II—II in FIG. 1, when there is no current in the control coil, FIG. 3 is a view corresponding to FIG. 2, in the condition in which the control coil is sufficiently energised, FIG. 4 shows a view of the control magnet system according to the invention in section taken along line IV—IV in FIG. 2, FIG. 5 shows a view of an alternative embodiment of the control magnet system according to the invention in section taken along line V—V in FIG. 7, when there is no current in the control coil, FIG. 6 shows a view corresponding to FIG. 5, in the condition of energisation of the control coil, FIG. 7 shows a view in section taken along line VII—VII in FIG. 5, and FIGS. 8 to 10 are diagrammatic views of the possible limit positions of the armature of the control magnet system shown in FIGS. 5 to 7.

FIG. 1 shows a control magnet system 1 in conjunction with a pattern apparatus as shown in FIG. 32 of DOS No. 25 31 762 to which reference is hereby expressly made. Knitting needles or other knitting implements 2, for example sliders, sinkers or pressers are mounted movably in a flat knitting machine. Also rotatably mounted in the machine is a drive shaft 3 on which a number of eccentric cam discs 4, corresponding to the number of knitting implements 2, the cam discs 4 being angularly displaced relative to each other, is non-rotatably arranged in a row. A drive element 5 in the form of a fork is fitted onto each cam disc 4 and has two arms which are connected by a connecting web portion and which engage around the cam disc in such a way that each drive element 5 is alternately raised and lowered when the associated cam disc 4 rotates. Adjacent drive elements 5 are spaced by a respective web portion 6.

Provided on each drive element is a shank 7 which is mounted in a spring 8 so that, on the one hand, the drive element 5 is biassed by the spring 8 towards the cam disc 4, while on the other hand the drive element 5 can carry out similar movements as when mounted in a slide and rotary mounting. Each drive element 5 also has a step-shaped recess 9 by means of which the knitting implement 2 can be raised into a knitting or catching position or held in the non-knitting position, depending on the position of the drive element. Independently of the position of the drive element, each knitting implement 2 which has been partly or completely pushed out is pulled back again in the pull-back movement of the drive element 5.

The control magnet system 1 which provides for controlling the knitting implements 2 according to the pattern to be produced includes a controllable holding magnet and an armature 10 in the form of a control spring which is clamped in the needle bed by one end of the armature. The free end of the armature can be caused to lie against the pole surface of the holding magnet against its spring force, by means of a projection 11 provided on the shank 7. When the armature 10 remains attracted to the holding magnet, the drive element 5, upon further rotation of the cam disc 4, is pressed thereagainst so that the knitting implement 2 is lifted into the knitting position by the higher step in the stepped recess 9. If on the other hand the armature 10 is released by the holding magnet at a moment at which one of two recesses 12 on the shank 7 is below the free end of the armature 10, the end of the armature drops into one of the recesses 12 so that the drive element 5 is prevented from being further pressed against the cam disc 4 and the knitting implement 2 is either pushed out into the catching position by the lower step in the stepped recess 2, or the knitting implement 2 is not pushed out at all. Further features of this apparatus can be found in DOS No. 25 31 762, but are not required for comprehension of the invention.

Referring now to FIGS. 2 to 4, the control magnet system 1 includes a permanent magnet 14 which extends over a plurality of adjacent armatures 16 which are designed for example as shown in FIG. 1 and which are each arranged between a respective pair of bar members 15. One pole of the permanent magnet 14 (for example the North pole N) is connected to a number of soft iron pole shoes, corresponding to the number of armatures 16 which are bridged thereby. The pole shoes form control poles 17, are surrounded by respective control coils 18 and each have a respective armature 16 associated therewith. The lower ends of the control poles 17 terminate closely above the upper edges of the bar members 15 so that, when the armatures 16 lie against the pole surfaces 19 of the control poles 17, the armatures 16 are still disposed partly between the two adjacent bar members 15 associated therewith. Moreover, as shown in FIGS. 2 to 4, the bar members 15 are arranged parallel to the plane in which the centre lines of the armatures 16 move up and down during the control operation. The other pole of the permanent magnet 14 (for example the South pole S) is connected to a soft iron pole shoe 20 which extends over the same number of armatures 16 as the permanent magnet 14 and which lies with its free end on the bar members 15. The surfaces of the bar members 15 which are disposed opposite the armatures 16 when they lie against the pole surfaces 19 thus represent pole surfaces 21 of co-operating poles which are formed by the bar members 15 themselves.

A feature of the invention provides that the free end of the armature 16 is freely movable relative to the two pole surfaces 19 and 21, that is to say, it is not secured thereto or in the vicinity thereof, and that the pole surfaces 19 and 21 form an angle to each other, for example, they are substantially perpendicular to each other. When the control coil 18 is not energised, the above-described arrangement provides a magnetic circuit which is shown by the arrows in FIG. 2 and which begins at the North pole N of the permanent magnet 14, and thereafter includes the control pole 17, a part of the armature 16, a part of at least one bar member 15 and the pole shoe 20, and then ends at the South pole S of the permanent magnet 14; the position of the permanent magnet 14 may also be reversed and the flux could therefore go in the opposite direction. The important consideration in this respect is that the resultants of the forces applied to the armature 16 by the control pole 17 and the co-operating pole (part of the bar member 15) respectively act in different directions and the control pole 17 primarily controls the attraction of the armature 16 to the pole surface 19, whereas the co-operating pole primarily influences the friction of the armature 16 against one of the two pole surfaces 21 during the armature release movement. As long as the component of the spring force which causes release of the armature 16 is sufficiently greater than that force which is in opposition to said component and which results from the friction of the armature 16 against a pole surface 21, there is no danger of the armature release process being influenced to any substantial degree, even from the point of view of the time involved. In this respect it is also irrelevent which of the two pole surfaces 21 which co-operate with the armature applies a greater attraction force to the armature 16, because the forces applied by the pole surfaces 21 adjacent an armature 16 are in opposite directions to each other and therefore substantially cancel each other out.

Because of the flux path shown in FIG. 2, it is sufficient for the field which is normally produced in the control pole 17 by the permanent magnet 14 to be weakened, compensated or reversed to such an extent, by means of the control coil 18, that on the one hand the force applied to the armature 16 by the control pole 17 is less than the component of the spring force which acts in the direction of armature release, and on the other hand the frictional forces produced by the co-operating poles are quickly and reliably overcome by the component of the spring force which acts in the direction of armature release. This applies in respect of all circumstances in which the pole surfaces 19 and 21 of the control pole 17 and the co-operating pole (component 15) are at such an angle to each other than the control pole 17 applies the predominant part of the attraction effect to the armature 16. In FIG. 3, the arrows indicate the approximate path of the flux in the case where the control coil 18 is so controlled that the armature 16 can fall away from the control pole 17.

In the embodiment shown in FIGS. 5 to 7, the arrangement is also such that the pole surfaces of the control pole and the co-operating pole are of such a configuration and arrangement that the predominant part of the attraction force is exerted on the armature 16 by the control pole. As in the embodiment shown in FIGS. 2 to 4, the armatures 16 are also mounted between bar members 15 in such a way that at least the parts of the bar members 15 which form the co-operating poles, said parts being operative as pole surfaces 21, are arranged substantially parallel to the direction of the movement of the armature 16 which is produced by the spring force, or substantially parallel to the plane in which occurs the movement, produced by the spring force, of the axis of the armature 16 which is in the form of a spring bar. The only difference between the control magnet system shown in FIGS. 5 to 7 and that shown in FIGS. 2 to 4 is that, at the outward sides, it has two respective pole shoes 23 and 24 which are extended over a number of bar members 15 and armatures 16 and which are connected to the bar members; in addition, a respective permanent magnet 25 and 26 which also extends over the number of bar members 15 and armatures 16 is secured to the upper ends of the respective pole shoes 23 and 24. Arranged between the oppositely disposed permanent magnets 25 and 26 are respective pairs of pole shoes which each form a respective control pole 27 or 28, are each connected to a respective permanent magnet 25 or 26, and each carry a respective control coil 29 or 30. Like the control poles 17 (FIGS. 2 to 4), the control poles 27 and 28 comprise flat members whose thickness approximately corresponds to the thickness of an armature 16. In addition, the control poles 27 and 28 which are associated together in pairs are arranged in the same respective plane so that their ends adjoin each other in a flush condition. The ends of the control poles 27 and 28, which project out of the control coils 29 and 30 respectively, are bent sideways, that is to say, in the direction parallel to the longitudinal axes of the permanent magnets 25, 26 and the pole shoes 23, 24, but in opposite directions relative to each other, whereby each control pole is associated with a respective armature, as can be clearly seen from FIG. 7. FIGS. 5 and 7 also include arrows showing the flux path when the control coil 30 is not energised, while FIG. 6 shows arrows illustrating the flux path when the control coil 30 is sufficiently strongly energised. The embodiment shown in FIGS. 5 to 7 corresponds in its mode of operation to the embodiment of FIGS. 2 to 4, but, by virtue of the interlocked structure, it additionally permits the production of particularly compact and space-saving control magnet systems.

Figure 8:
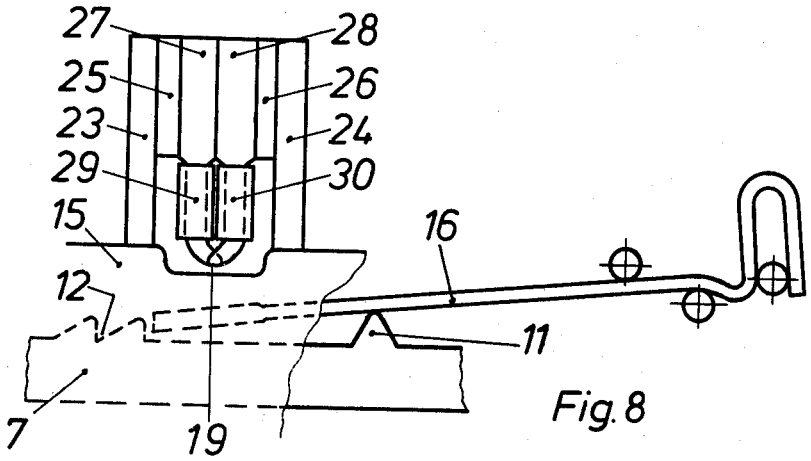
Figure 9:
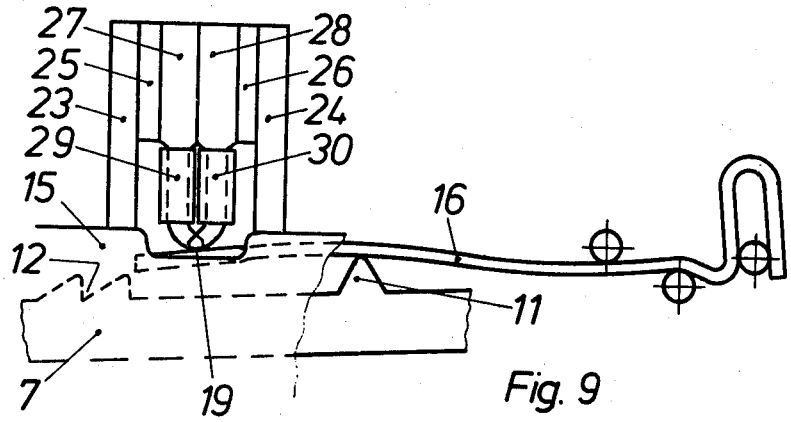
Figure 10:
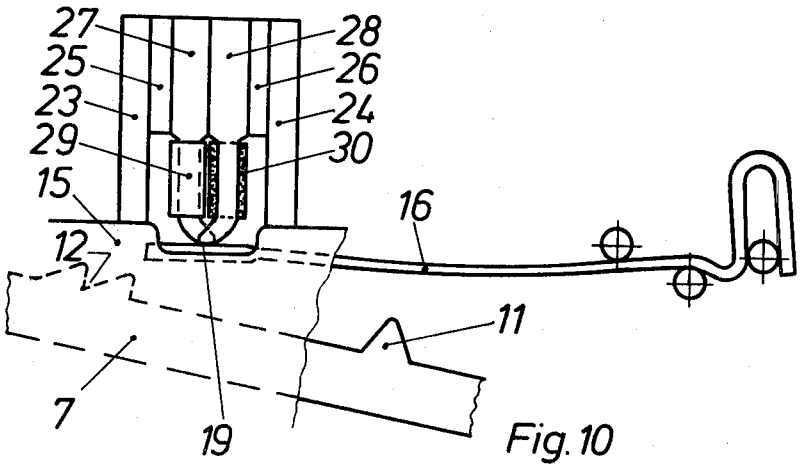

As shown in particular in FIGS. 2, 3, 5 and 6, the pole surfaces 19 of the control poles 17 have a rounded configuration or curvature portion of relatively large radius of curvature, so that, although the armatures 16 are in substantially only point or line contact with the pole surface 19, nonetheless there are always approximately equal air gaps formed on both sides of the contact line. As can be seen from FIGS. 8 to 10, the curvature permits automatic adaptation of the pole surface 19 to different contact angles of the armature 16, without disadvantageous consequences in regard to the magnetic conditions. In FIG. 8, the shank 7 of the drive element 5 (FIG. 1) is still in a lowered position, while the armature 16 is in the released position. In the subsequent upward stroke movement of the drive element 5, the shank 7 is raised, as shown in FIG. 9, in such a way that the projection 11 engages under the armature 16 and applies the armature against the pole surface 19 of the control pole. In this arrangement, the maximum upward movement of the shank 7 is achieved only when the armature 16 has been deflected in the manner shown in FIG. 9, and its end which bears against the pole surface 19 includes a positive angle of about 12° to the horizontal, so that the end of the armature is reliably applied against the pole surface 19 without an air gap, even when there are tolerance variations. Finally, FIG. 10 shows a moment at which the shank 7 is in its downward stroke movement while the armature 16 has remained against the pole surface 19 and, by virtue of its inherent resilient forces, has assumed the configuration shown in FIG. 10, so that its end lies against the pole surface 19 approximately in a horizontal direction. Finally, by virtue of manufacturing and assembly tolerances, the condition (not shown) may occur, in which the end of the armature 16 which is attracted to the control pole includes a negative angle to the horizontal. By virtue of the curvature of the pole surface 19, under all circumstances, the apparatus has approximately the same magnetic conditions and comparable air gaps on both sides of the contact line so that all armatures 16 are released, irrespective of their contact angle, when they are actuated at the same time, within very close tolerances, within the same short periods of time. The release times are not substantially influenced by films of oil or the like which adhere to the contact surfaces because the adhesion of the armatures 16 to the pole surfaces 19 is relatively slight, because of the curved configuration. In addition, because of the large radius of curvature of the rounded configuration of the pole surfaces 19, the air gaps between the armatures 16 and the pole surfaces 19, when the armatures are in contact with the pole surfaces, are very small, over a sufficiently large range, so that the forces required to cause the armature to cling to the pole surfaces can be produced with relatively small permanent magnets. The fact that the armatures 16 slide in the axial direction on the pole surface 19 when moving from the position shown in FIG. 9 into the position shown in FIG. 10 has the advantage result of simultaneously providing a self-cleaning action.

The above-described control magnet systems are for example combined to form blocks or units each of which comprises thirty six control poles, which corresponds to a block or unit length of 50 mm with an 18s-pitch. For the purposes of manufacturing control magnet systems with different pitches, it is possible to use the same control poles and control coils, and for them to be secured to the permanent magnets at the desired spacings. Particularly in the embodiment shown in FIGS. 5 to 7, it is possible to produce pitches of less than 1 mm.

The invention is not restricted to the described embodiments which may be modified in various ways. In particular the shape of the illustrated pole shoes, armatures and bar members and the spatial arrangement thereof may be varied, provided only that it is certain that the predominant part of the attraction force is applied to the armature by the control pole. It is also possible if necessary for more than one control pole and fewer or more than two co-operating poles to be associated with each armature. In addition, the invention is in particular not restricted to the above-described kind of use but may be correspondingly used for example in conventional flat knitting machines, circular knitting machines or weaving machines. Finally, as shown in the drawings, the bar members 15 may be hollowed out or recessed in the region of the control magnet systems.

Instead of the spring bars, it is possible to provide other armatures 16, for example members which are biassed by special springs. These members may also comprise pressers, sinkers, needles or parts thereof (see for example DAS No. 17 60 405).

I claim:

1. A control magnet system for a pattern apparatus on a textile machine, in particular a knitting machine, comprising at least one permanent magnet which includes at least one control pole having a pole surface and controllable by means of a control coil and at least one co-operating pole having a pole surface, and comprising at least one armature which is freely movable relative to the two poles and which can be applied against the pole surface of the control pole against a spring force in such a way that, when the control coil is not energised, the armature remains against the pole surface of the control pole by virtue of the magnetic force produced by the permanent magnet, whereas, when the control coil is energised, the armature is released from the pole surface of the control pole by virtue of the spring force, wherein the pole surface of the control pole is arranged substantially perpendicular to the direction of release of the armature, characterised in that the pole surface (21) of the co-operating pole (15) is arranged substantially perpendicular to the pole surface (19) of the control pole (17 or 27, 28).

2. A control magnet system according to claim 1 characterised in that the armature (16) is a spring bar which is gripped at one end and which has a portion which is substantially linear in the region of action of the pole surfaces (19, 21) and that the pole surfaces (19, 21) of the control pole (17 or 27, 28) and the co-operating pole (15) are arranged substantially parallel to the linear portion of the spring bar.

3. A control manget system according to claim 1 or claim 2 characterised in that the pole surface (21) of the co-operating pole (15) is arranged substantially parallel to a wide side of that area or that space in which movement of the armature (16) caused by the spring force occurs.

4. A control magnet system according to one of claims 1, or 2 characterised in that the pole surface (19) of the control pole has a cylindrical rounded portion with a large radius of curvature, for the purposes of adaptation to different contact angles of the armature (16), wherein the axis of the cylinder is arranged perpendicularly to the axis of the spring bar (16).

5. A control magnet system according to one of claims 1, or 2 characterised in that the permanent magnet (14) comprises a second co-operating pole (15) parallel to the said co-operating pole (15), whereby the two co-operating poles (15) are arranged at the two oppositely disposed wide sides of that area or space in which the movement of the armature (16) produced by the spring force occurs.

6. A control magnet system according to one of claims 1, or 2 for a flat knitting machine having a multiplicity of knitting implements which are mounted in juxtaposition and each of which has associated therewith a respective permanent magnet and a respective armature, characterised in that the armatures (16) are arranged, in accordance with the needle pitch, between respective pairs of bar members (15) which comprise magnetically conducting material and which form the co-operating poles, and that each permanent magnet (14 or 25, 26) is of a width corresponding to a plurality of adjacent bar members (15) and armatures (16) and has a pole shoe (20 or 23, 24) which is of corresponding width and which is connected to the bar members (16), each permanent magnet further having a number of pole shoes corresponding to the number of armatures (16), which pole shoes form the control poles (17 or 27, 28) and each of which is associated with a respective armature (16) and is arranged between or directly above a respective pair of bar members (15) and is surrounded by a respective control coil (18 or 29, 30).

7. A control magnet system according to claim 6 characterised in that there are provided respective pairs of permanent magnets (25, 26) and pairs of pole shoes (23, 24) which are connected to the permanent magnets and to the bar members (15), and that within the limits defined by each two adjacent armatures (16), there are provided a respective pair of control poles (27, 28) which are arranged one behind the other in a direction parallel to the bar members (15), are each connected to a respective one of the two permanent magnets (25, 26), and are each surrounded by a respective control coil (29, 30), wherein each control pole (27, 28) is associated with one of the two adjacent armatures (16) and for that purpose has a free end which is bent to correspond to the pitch.

* * * * *